US005794944A

United States Patent [19]

Roberts

[11] Patent Number: 5,794,944

[45] Date of Patent: Aug. 18, 1998

[54] MONEY MACHINE

[76] Inventor: Le Roy Roberts, R.D. #1, Box 173R, Breezewood, Pa. 15533

[21] Appl. No.: 682,854

[22] Filed: Jul. 12, 1996

[51] Int. Cl.[6] ..... A63B 71/02; E04B 1/34

[52] U.S. Cl. ..... 273/447; 52/2.17; 52/2.18; 273/458; 472/134

[58] Field of Search ..... 273/447, 457, 273/458; 472/134; 52/2.17, 2.18; 128/205.26

[56] References Cited

U.S. PATENT DOCUMENTS 1,858,400 5/1932 Koehler ..... 128/205.26 X
2,597,655 5/1952 Marson .
3,318,308 5/1967 Grosholz ..... 128/205.26 X
5,471,797 12/1995 Murphy ..... 52/2.17

*Primary Examiner*—William H. Grieb
*Attorney, Agent, or Firm*—Dwight G. Diehl

[57] ABSTRACT

The present device is to be utilized in fundraising projects. It has a hollow frame which supports a plastic enclosure. The enclosure has an entrance which can be opened and closed. Once a participant enters the enclosure and closes the entrance, an air blower is activated. With activation of the blower, prize money is circulated within the enclosure, which the participant tries to catch.

10 Claims, 3 Drawing Sheets

MONEY MACHINE

BRIEF DESCRIPTION

The present invention involves the use of common, well-known elements combined in a new and unique way. Tubular stock is used to form a frame. A clear plastic bag is then attached to the frame. An air blower is attached to the device such that when it is activated air blows into the plastic bag. The air then circulates within the device and causes whatever material is in the device to circulate.

The present device is envisioned to be used in fundraising projects. Money is placed inside the device, a contestant or winner enters the device, the blower is turned on and the individual has a fixed period of time in which to grab as much money as possible.

DETAILED DESCRIPTION OF THE INVENTION

Figure 1:
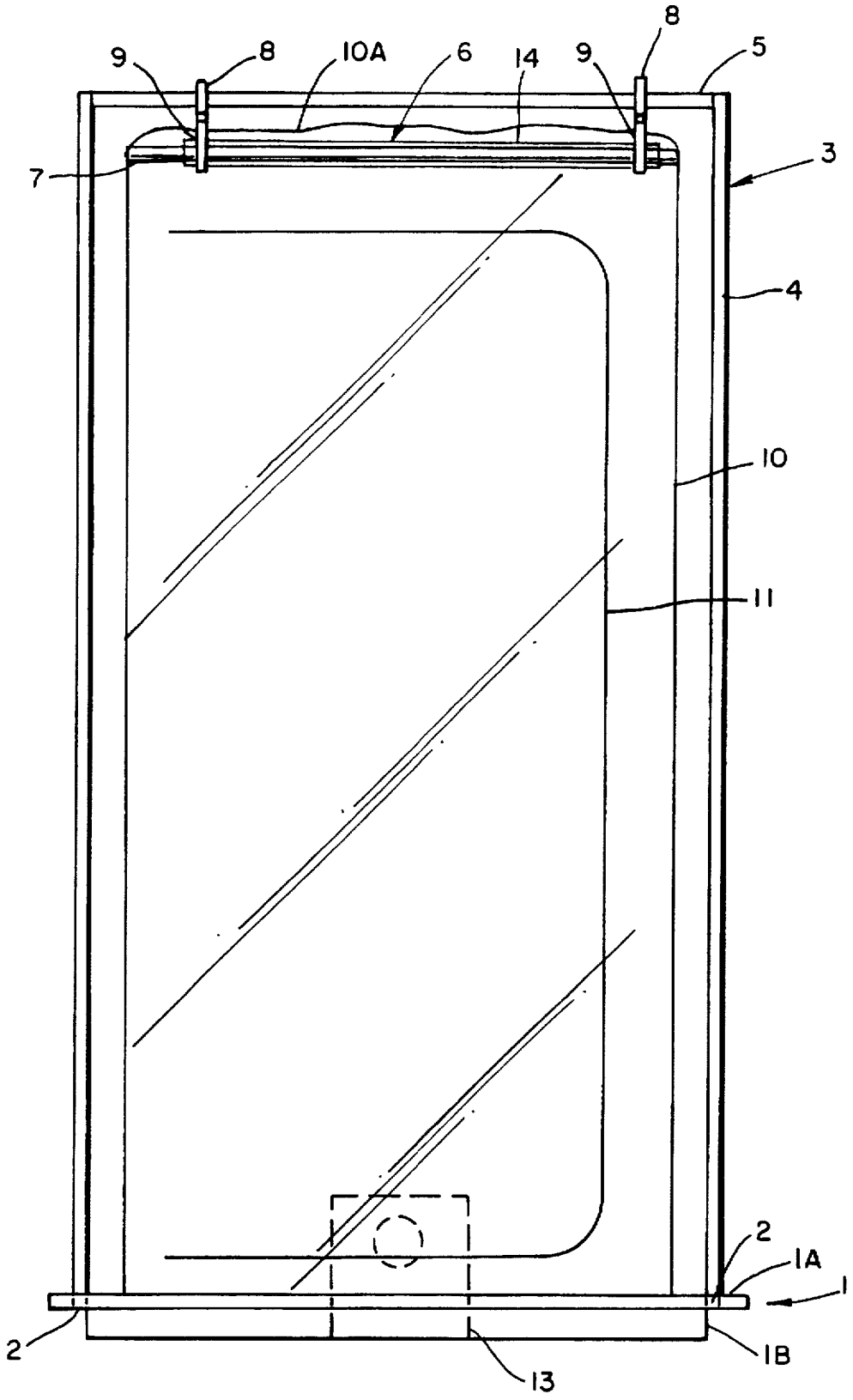
FIG. 1 is a frontal view showing the device in the fully assembled condition.
Figure 2:
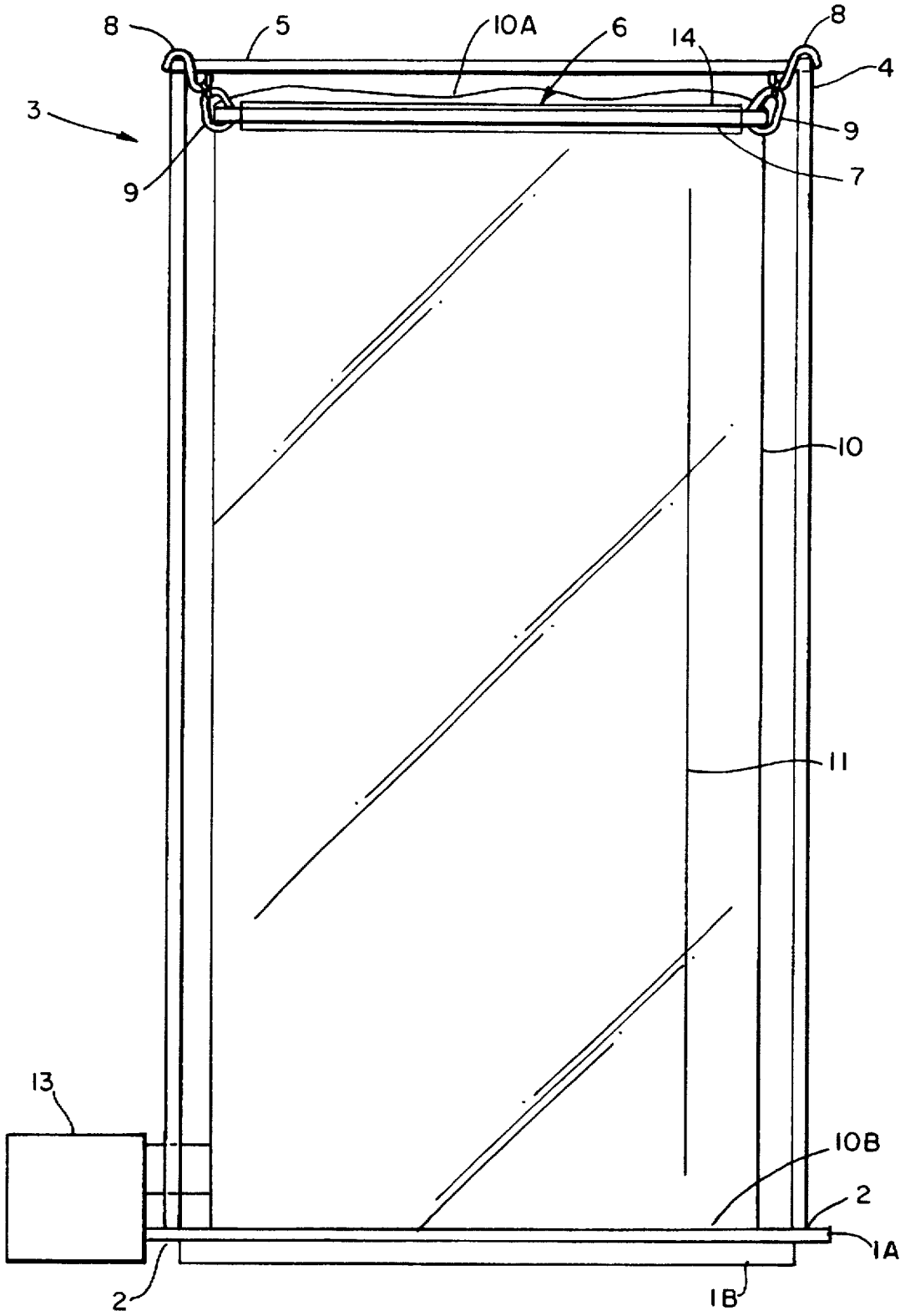
FIG. 2 is a side view of the assembled device.
Figure 3:
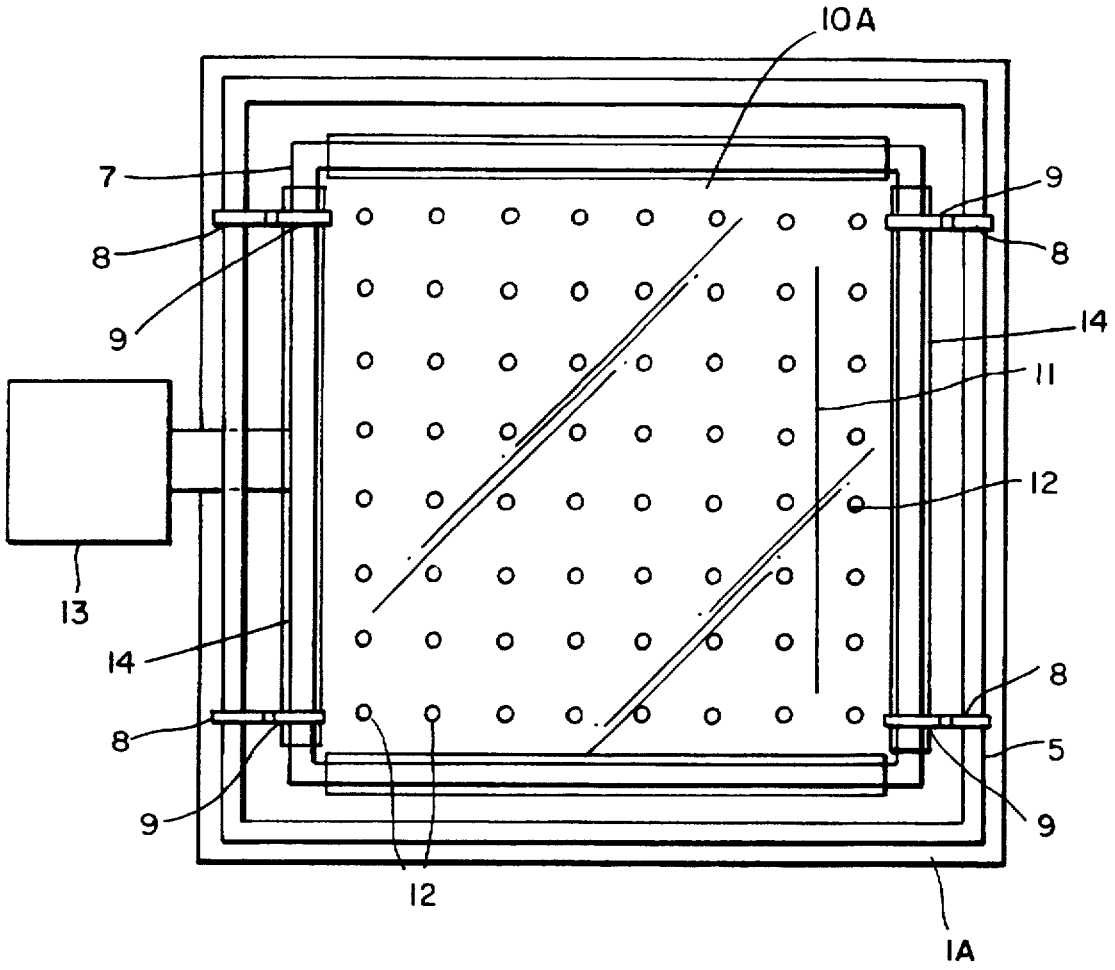
FIG. 3 is a top view of the completed device.

FIG. 1 shows the device in a completed condition. The base 1 is a 30 inch square, flat support la supported by 2"×4" supports 1*b*. The base contains four apertures 2. Each aperture is ideally five-eighths of an inch in diameter. The frame 3 is comprised of hollow material, preferably one-half inch copper tubing. The frame when mounted on the base, stands 6 foot 2 inches from the base. The frame 3 is removably attached to the base 1 by the apertures 2.

The frame 3 is comprised of four upright, vertical members 4 and four horizontal members 5 attached to and interconnecting the vertical members 4. Attached to the horizontal members 5 is a twenty-seven inch square bag support 6. The bag support is comprised of four members 7 interconnected to form a square rectangle. The preferred material used in making the bag support is a heavy gauge PVC pipe that is commercially available.

The bag support is attached to the horizontal members 5 of the frame 3 by hook means, comprised of hooks 8 attached to the frame, and spring means, comprised of springs 9 attached to the bag support. Four hooks and four springs are used in the preferred embodiment and are located on two opposing sides of the bag support.

A clear plastic bag 10 made of heavy gauge clear plastic is supported on the bag support 6. The bag 10 includes an entry means, ventilation means, circulator, and attachment means. The entry means is a zippered doorway 11 through which one can enter the bag. The ventilation means is comprised of a plurality of apertures 12 in the top 10A of the bag. The circulator is an air blower 13 that forces air into the bag. The blower 13 is of the type commercially available, and known to one of ordinary skill in the art, and utilized in leaf blowers. The blower 13 will not be described in any further detail, in as much as, it is not new or novel. The attachment means is comprised of two flaps 14 extending from the top of the bag and each flap has two apertures to accommodate the springs 9.

The bag is fastened to the bag support 6 by the springs 9. The springs pass through the apertures and around the bag support 6. The hooks 8 are then connected to the springs at one end and to the horizontal members 5 at the opposite end.

The bag 10 now hangs down from the bag support and is inside the vertical members 4 of the frame.

Once the bag is attached to the frame, the blower is attached. The blower is connected near the bottom of the bag, on a side opposite the door 11. The bottom 10B of the bag rests on the base 1. The blower is attached to the bag by way of a hole in the side of the bag.

Once the blower is attached the device is ready for operation. The present device is designed and intended to be used in fundraising type circumstances for the awarding of prizes. When the device is assembled, paper U.S. currency is placed inside the bag. Next a contestant or prize winner enters the bag through the door. The door is then zippered shut and the blower is turned on. The blower will circulate air within the bag and thus circulate the currency. The air and currency will continue to circulate, with the air passing through the apertures 12 at the top 10A of the bag. After a fixed period of time the blower will be turned off and the contestant will exit the bag with their prize, the currency they caught when in the bag.

The present device has been described in its' preferred embodiment. However, it would be obvious to one of ordinary skill in the art, that modifications can be made without departure from the scope of the present invention. For example, the frame could readily be constructed from material other than copper tubing, i.e. PVC pipe, galvanized pipe, etc. Also, the bag support could be made of other types of materials. The bag support can be made of a one piece design or made such that the square can be readily assembled and disassembled. Also, the size of the present device, the frame, the base, and the bag are illustrative and deemed to be the most practical, however, a change in sizing would be contemplated and considered on obvious modification.

I claim:

1. A device comprising:

a base;

a frame mounted on said base;

a bag support attached to said frame;

a bag; and a blower;

said bag including an entry way, a top, a bottom, ventilation means, support flaps.

2. A device as recited in claim 1, further comprising:

the frame includes vertical members and horizontal members.

3. A device as recited in claim 1 further comprising:

said bag support is a rectangular member.

4. A device as recited in claim 3, further comprising:

spring means and hook means for connecting said bag support to said frame.

5. A device as recited in claim 2 further comprises:

said bag support connected to said horizontal members;

spring means;

hook means;

said spring means attaches said support flaps to said bag support and are connected to said hook means;

said hook means is connected to said spring means and to said frame.

6. A device as recited in claim 5, further comprising:

said springs means comprises four springs; and said hook means comprises four hooks.

7. A device as recited in claim 5, further comprising:

said bag is attached to said blower at a side opposite said entry way;

said entry way includes a zipper means for opening and closing said entry way.

8. A device as recited in claim 5, further comprises:

said ventilations means is a plurality of apertures located in the top of said bag.

9. A device comprising:

spring means;

hook means;

a base having apertures;

a frame comprising vertical members, removably inserted in the base apertures, and horizontal members;

a bag support;

a bag comprising an entry way, a top with ventilation means, support flaps, a bottom, and a top; and a circulating means; wherein said bag support is removably attached to said horizontal members by said spring means and said hook means.

10. A device is recited in claim 9, further comprising:

said circulating means is attached to said bag on a side opposite said entry way.

* * * * *